US006270188B1

(12) United States Patent
Tandou et al.

(10) Patent No.: US 6,270,188 B1
(45) Date of Patent: Aug. 7, 2001

(54) INK JET PRINTER AND CONTROL METHOD THEREOF

(75) Inventors: Katsuyoshi Tandou; Kunio Hakkaku, both of Tokyo (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/239,320

(22) Filed: Jan. 29, 1999

(30) Foreign Application Priority Data

Jan. 29, 1998 (JP) ..... 10-017295

(51) Int. Cl.[7] ..... B41J 2/21; B41J 2/135; B41J 29/38

(52) U.S. Cl. ..... 347/43; 347/44; 347/9

(58) Field of Search ..... 347/43, 14, 40, 347/9, 44

(56) References Cited

U.S. PATENT DOCUMENTS 4,631,548 * 12/1986 Milbrandt ..... 347/43
5,220,342 * 6/1993 Moriyama ..... 347/43
5,717,448 * 2/1998 Inada ..... 347/43

FOREIGN PATENT DOCUMENTS 0 445 916 9/1991 (EP) .

OTHER PUBLICATIONS

Patent Abstracts of Japan vol. 018, No. 055 (M–1550), Jan. 28, 1994.

* cited by examiner

*Primary Examiner*—Thinh Nguyen
(74) *Attorney, Agent, or Firm*—Sughrue, Mion, Zinn, Macpeak & Seas, PLLC

(57) ABSTRACT

A control method of an ink jet printer having an ink jet head which ejects an ink droplet to record a dot on a recording sheet. When plural colors of ink are overlapped to record a dot, each color ink ejection time length is set shorter as compared with when a single-color dot is recorded. Ink amount in the dot in which the plural colors are overlapped is reduced, and ink blur on the recording sheet is prevented from occurring, so that recorded image quality can be enhanced. Preferably, ejection time width of one dot of ink ejected from the ink jet head is divided into plural pitches, each pitch is associated with an address of a timing data memory, and timing data is prepared by storing data indicating plural ejection time lengths of the ink jet head in the address corresponding to an ejection timing. Selection information for selecting any one of the ejection time lengths is included in record data for each dot, the ejection timing for each dot is determined from the timing data based on the ejection time length selected by the selection information of the record data, and each dot ink ejection time length is controlled.

10 Claims, 8 Drawing Sheets

FIG.6

1ST HEAD TIMING DATA

8TH HEAD TIMING DATA

| | | | | | | | | | |
|---|---|---|---|---|---|---|---|---|---|
| 1 | 1 | 1 | 1 | 1 | 1 | 1 | 1 | 0 | |
| | 0 | 0 | 0 | 0 | 0 | 0 | 0 | 0 | |
| | 1 | 1 | 1 | 1 | 1 | 1 | 1 | 0 | |
| | 0 | 0 | 0 | 0 | 0 | 0 | 0 | 0 | |
| | 1 | 1 | 1 | 1 | 1 | 1 | 1 | 0 | |
| | 0 | 0 | 0 | 0 | 0 | 0 | 0 | 0 | |
| | 1 | 1 | 1 | 1 | 1 | 1 | 1 | 0 | |
| | 0 | 0 | 0 | 0 | 0 | 0 | 0 | 1 | ← LONG EJECTION START DATA |
| | 0 | 0 | 0 | 0 | 0 | 0 | 0 | 0 | |
| | 0 | 0 | 0 | 0 | 0 | 0 | 0 | 1 | ← SHORT EJECTION START DATA |
| | 0 | 0 | 0 | 0 | 0 | 0 | 0 | 0 | |
| | 0 | 0 | 0 | 0 | 0 | 0 | 0 | 1 | ← LONG/SHORT EJECTION END DATA |
| | 0 | 0 | 0 | 0 | 0 | 0 | 0 | 0 | |
| | 0 | 0 | 0 | 0 | 0 | 0 | 0 | 1 | ← CHARGING END DATA |
| | 0 | 0 | 0 | 0 | 0 | 0 | 0 | 0 | |
| 16 | 0 | 0 | 0 | 0 | 0 | 0 | 0 | 0 | |

INK JET PRINTER AND CONTROL METHOD THEREOF

BACKGROUND OF THE INVENTION

1. Field of the Invention

The present invention relates to an ink jet printer and its control method, particularly to an ink jet printer and its control method in which when one dot is recorded with a plurality of colors of ink overlapping, ink blur is prevented from being generated in a recording sheet.

2. Description of the Related Art

In general, an ink jet printer is used as an output device of a computer, a word processor, or the like.

In a conventional ink jet printer, a carriage shaft is disposed in a direction parallel with a platen, and a reciprocatable carriage is disposed along the carriage shaft. Moreover, an ink jet recording head is mounted on the carriage to oppose the platen in such a manner that a head nozzle of the ink jet faces a printing face of the platen.

According to the above conventional ink jet printer, a recording sheet is conveyed between the platen and the ink jet head. While the carriage having the ink jet head mounted thereon moves along the platen, the nozzle of the ink jet head is operated on the basis of a predetermined printing signal, so that the desired ink is ejected or discharged from the nozzle toward the recording sheet on the platen. Thus, a desired image is recorded or printed on the recording sheet.

In such conventional ink jet printer, for example, yellow, magenta, cyan and black inks are used to perform full-color recording. In this case, when the yellow, magenta, cyan and black inks are all ejected from the respective nozzles to record a certain dot, the amount of ink ejected for one dot becomes remarkably large as a result. This causes a problem that the recorded dot blurs and becomes hazy or indistinct, resulting in the deterioration of the recording quality.

SUMMARY OF THE INVENTION

The present invention has been accomplished in consideration of the aforementioned circumstances, and a first object thereof is to provide an ink jet printer control method in which when a plurality of colors of ink are overlapped to record a dot, ink blur can be prevented from being generated in a recording sheet.

A second object of the present invention is to provide an ink jet printer which prevents occurrence of ink blur when a plurality of colors of ink are overlapped to record a dot on a recording sheet.

The first object of the present invention is attained by the provision of a control method of an ink jet printer having an ink jet head which ejects an ink droplet to record a dot on a recording sheet, the ink jet head being mounted on a carriage reciprocating in a direction substantially orthogonal to the conveying direction of the recording sheet. In the control method, when a plurality of colors of ink are overlapped to record a dot, each color ink ejection time period is set shorter as compared with when a single-color dot is recorded.

The first object of the invention is also attained by the provision of a control method of an ink jet printer having an ink jet head which ejects an ink droplet to record a dot on a recording sheet, the ink jet head being mounted on a carriage reciprocating in a direction substantially orthogonal to the conveying direction of the recording sheet, comprising the steps of:

dividing an ejection time width for recording one dot of ink ejected from said ink jet head into a plurality of pitches;

associating each pitch with an address of a timing data memory;

preparing timing data by storing data indicating plural ejection time lengths of said ink jet head in the address corresponding to ejection timing;

providing selection information for selecting any one of said plural ejection time lengths, said selection information being included in record data for each dot;

determining the ejection timing for each dot from said timing data on the basis of the ejection time length selected by the selection information of said record data; and controlling each dot ink ejection time length by the determined ejection timing.

The timing data may include a plurality of ejection start signals stored in different addresses and one ejection end signal. The record data may include the selection information for selecting any one from the ejection start signals. With such construction, ink ejection can be started from the address of the ejection start signal selected by the selection information and completed at the address of the ejection end signal.

RAM (Random Access Memory) for recording the record data for one scanning operation may also be used as the timing data memory. Moreover, while the record data for one dot is read and written into a shift register, the timing data is read in the address order to obtain the ejection start timing, and the amount or color of ink corresponding to the record data is controlled to be ejected at the obtained ejection start timing. The record data may include information for setting different ink ejection time lengths for one dot, while the timing data may include a plurality of ejection timings different in the ejection time length.

For example, the record data may include long record data indicative of a long ejection time and short record data indicative of a short ejection time. The timing data may include long ejection start data for starting ejection early when performing the ink ejection in the long ejection time, short ejection start data for starting ejection late when performing the ink ejection in the short ejection time, and ejection end data indicating the end of the long or short ejection time.

When a plurality of ink jet heads are provided, the data indicative of the ejection timing for each ink jet head can be used for independently changing the address in the timing data memory to independently change the ejection timing for each ink jet head. Therefore, when the address for storing the data indicative of the ejection timing can be changed for each ink jet head, the ejection timing of each ink jet head can independently and easily be controlled, which is convenient.

According to the present invention, the second object is attained by the provision of an ink jet printer in which an ink jet head is mounted on a carriage reciprocating in a direction substantially orthogonal to the conveying direction of a recording sheet, comprising:

CPU for outputting record data including data indicating ink ejection time length for each dot;

a record data memory for sequentially storing a predetermined volume of record data while said ink jet head is moving along a recording path;

a timing data memory for dividing an ejection time length for recording one dot of ink ejected from said ink jet head into a plurality of pitches, associating each pitch with an address position, and storing data indicating plural ejection time lengths in an address corresponding to ejection timing;

a timing signal generating circuit for reading and outputting the record data for one dot from said record data memory, and for reading the ejection timing corresponding to the ejection time length indicated by said record data from said timing data memory to output an ejection signal at a predetermined ejection timing; and a head driver for operating the ink jet head based on said record data for one dot and said ejection signal to eject the ink corresponding to said record data at said predetermined ejection timing.

The record data memory and the timing data memory may be shared for use by dividing the common memory (RAM or the like) into different storage areas for use. The record data of the ink jet head for one scanning operation is stored in the memory, and the record data is rewritten every time recording of one scanning operation is finished. Additionally, once the timing data is set, the same timing data is constantly used thereafter. When a plurality of, e.g., two memories are provided, the record data can be alternately rewritten corresponding to repetition of the scanning operation. In this case, while recording is performed by the ink jet head using one of the memories, next new record data can be written into the other memory. Therefore, data processing is smoothly performed, and processing rate can be raised.

Additionally, the record data for one scanning operation herein indicates record data for one line when one nozzle is assembled in the ink jet head. When a plurality of, e.g., four head nozzles are assembled in one ink jet head, however, four lines are simultaneously recorded. In this case, record data for four lines is indicated.

BRIEF DESCRIPTION OF THE DRAWINGS

FIG. 6 is an explanatory view showing recording condition of timing data in the control circuit of FIG. 3;

DETAILED DESCRIPTION OF THE PREFERRED EMBODIMENTS

Preferred embodiment of the present invention will be described hereinafter with reference to FIGS. 1 to 9.

Figure 1:
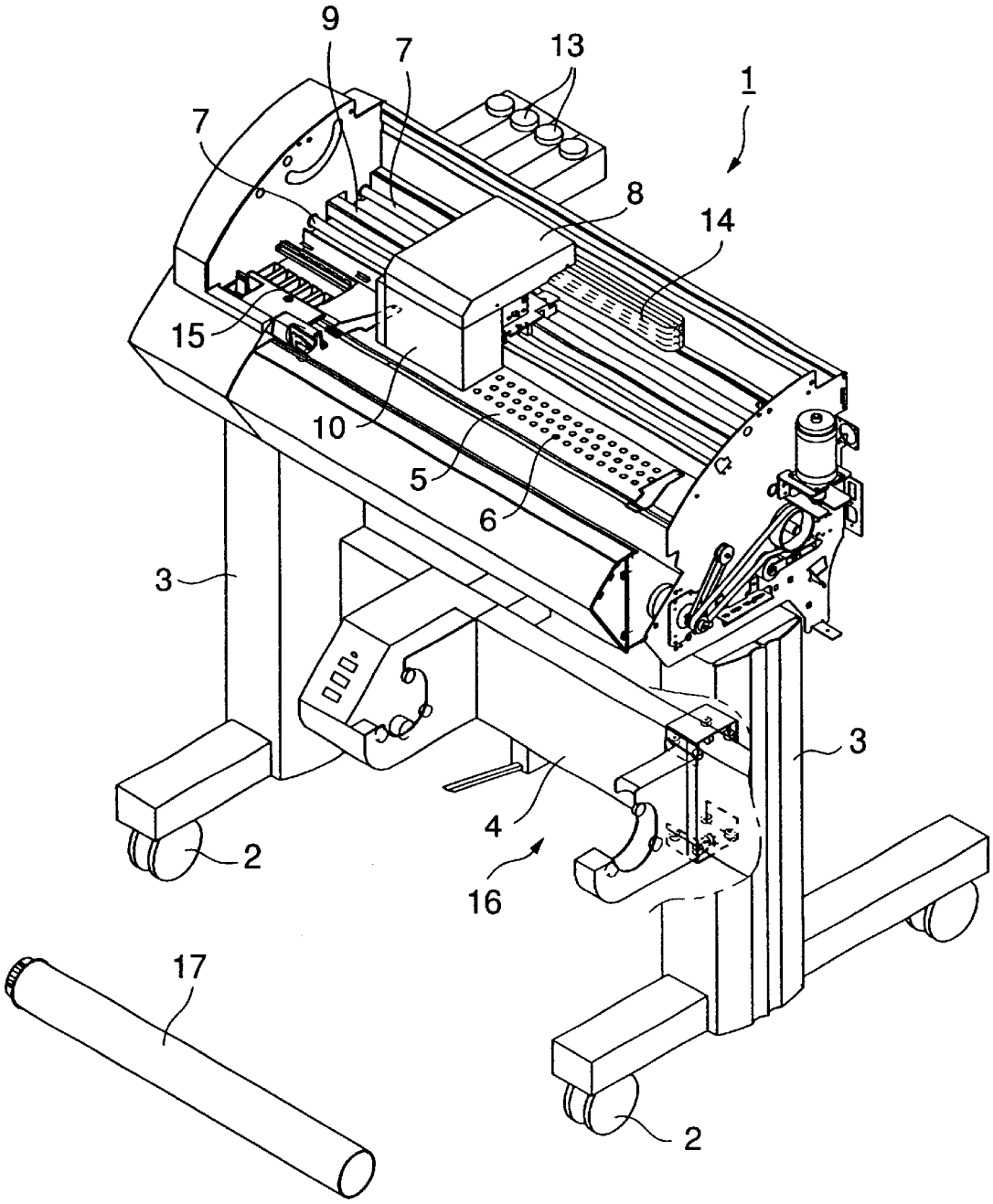
FIG. 1 is a perspective view showing one embodiment of an ink jet printer according to the present invention.

FIG. 1 shows one embodiment of an ink jet printer according to the present invention. A reference numeral 1 denotes a printer unit which is supported by a pair of stands 3, 3. A plurality of casters 2, 2 . . . are attached to the stands 3, 3. The stands 3, 3 are interconnected via an auxiliary frame 4 which is positioned in substantially the middle of each stand 3 in the vertical direction.

A plate-like platen 5 is oriented upward in the printer unit 1. A plurality of suction holes 6, 6 . . . are formed in the top surface of the platen 5. When a recording sheet (not shown) is fed on the surface of the platen 5, the sheet is sucked onto the top surface of the platen 5 by the action of the negative pressure in the suction holes 6. Accordingly, the recording sheet is fixedly adheres to the top surface of the platen 5. A pair of carriage shafts 7, 7 extending parallel relative to the longitudinal direction of the platen 5 are disposed behind the platen 5 in the printer unit 1. A reciprocatable carriage 8 is disposed along the carriage shafts 7. A carriage drive belt 9 positioned between the carriage shafts 7 is connected to the carriage 8. The carriage drive belt 9 is operated by a drive device (not shown) and, as a result, the carriage 8 is reciprocated along the carriage shafts 7.

Figure 2:
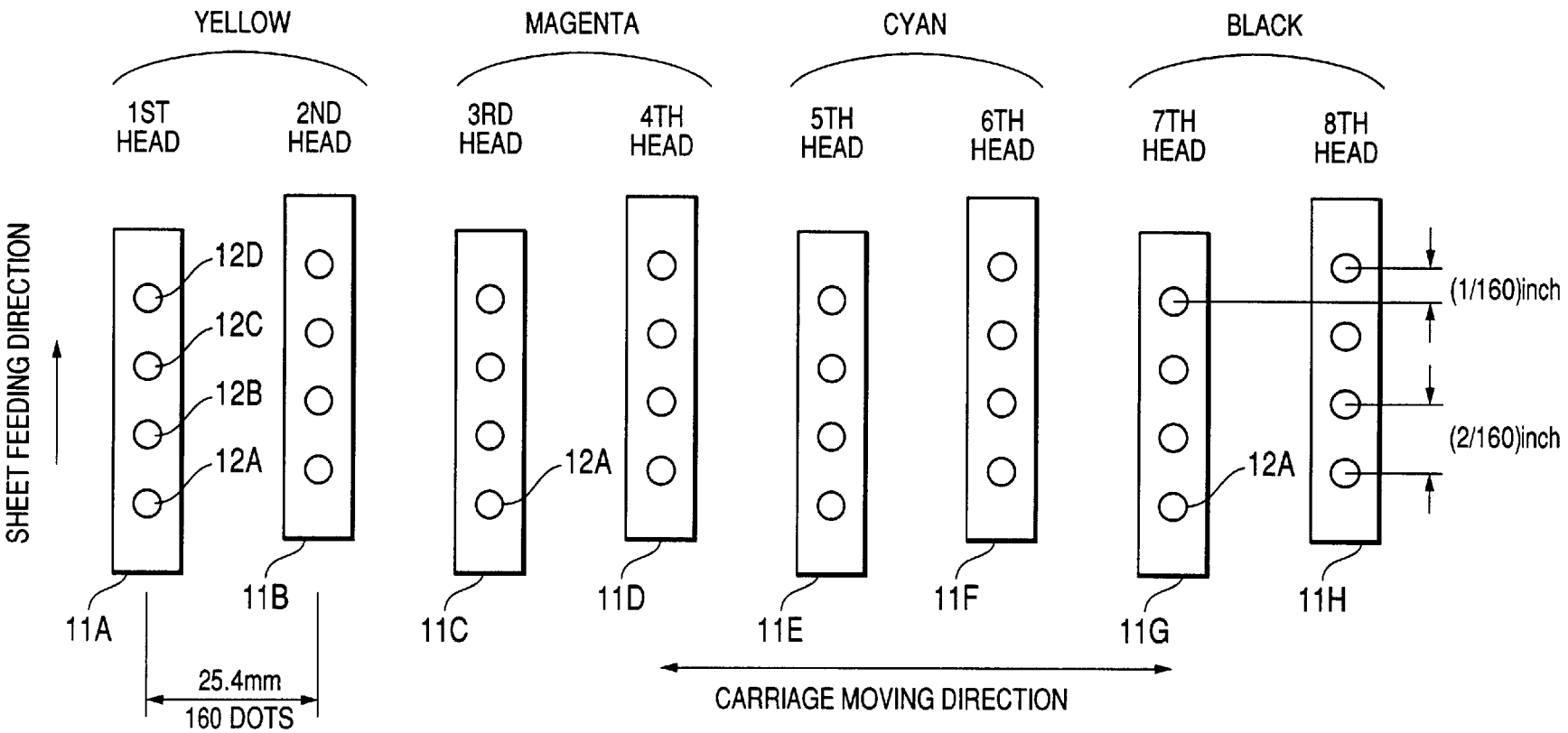
FIG. 2 is a schematic view showing the structure and arrangement of eight ink jet heads assembled in a head unit of the ink jet printer of FIG. 1.

A head unit 10 is disposed to the carriage 8 to face the platen 5. Ink jet heads 11 (11A to 11H) are assembled in the head unit 10 to face the printing surface of the platen 5. As shown in FIG. 2, in the embodiment, two ink jet heads 11 are provided for each of four colors of yellow, magenta, cyan and black, and eight ink jet heads 11A to 11H are provided in total. The ink jet printer of this embodiment has a recording resolution of 160 dpi (dots/inch), and therefore, two ink jet head 11 for each color are displaced with each other by 1/160 inch in the feeding direction of the recording sheet. Each of the ink jet heads 11A to 11H is provided with four head nozzles 12 (12A to 12D). For the description of operation, the eight ink jet heads 11A to 11H are shown as the first head 11A to the eighth head 11H in order from the left side in FIG. 2, and four head nozzles 12 (12A to 12D) assembled in each of the heads 11A to 11H are shown as the first nozzle 12A to the fourth nozzle 12D. In the embodiment, the operation of four head nozzles 12A to 12D will be described, but the number of the nozzles in the ink jet head is not limited to four and can appropriately be set.

As shown in FIG. 1, four ink tanks 13, each thereof for each color, are disposed on one side (left side) in the rear face of the printer unit 1. The ink tanks 13 communicate with the head unit 10 via an ink passage or a tube 14. The tube 14 supplies ink to each nozzle 12 of each ink jet head 11 from each ink tank 13 via the carriage 8.

Furthermore, one end (left end in FIG. 1 in the embodiment) of the platen 5 of the printer unit 1 is set in the home position of the head unit 10. A cap 15 is disposed in the position corresponding to the home position. The cap 15 covers the head nozzles 12, when not in use, to prevent the drying of ink inside the nozzles and the attachment of foreign particles. Moreover, the cap 15 sucks and collects the ink ejected by recovering operation to eliminate ink clogging in the nozzles 12 of the ink jet heads 11.

The auxiliary frame 4 is provided with a wind-up mechanism 16. The wind-up mechanism 16 includes a wind-up shaft 17 which is rotated synchronization with the feeding or conveying speed of the recording sheet.

Figure 3:
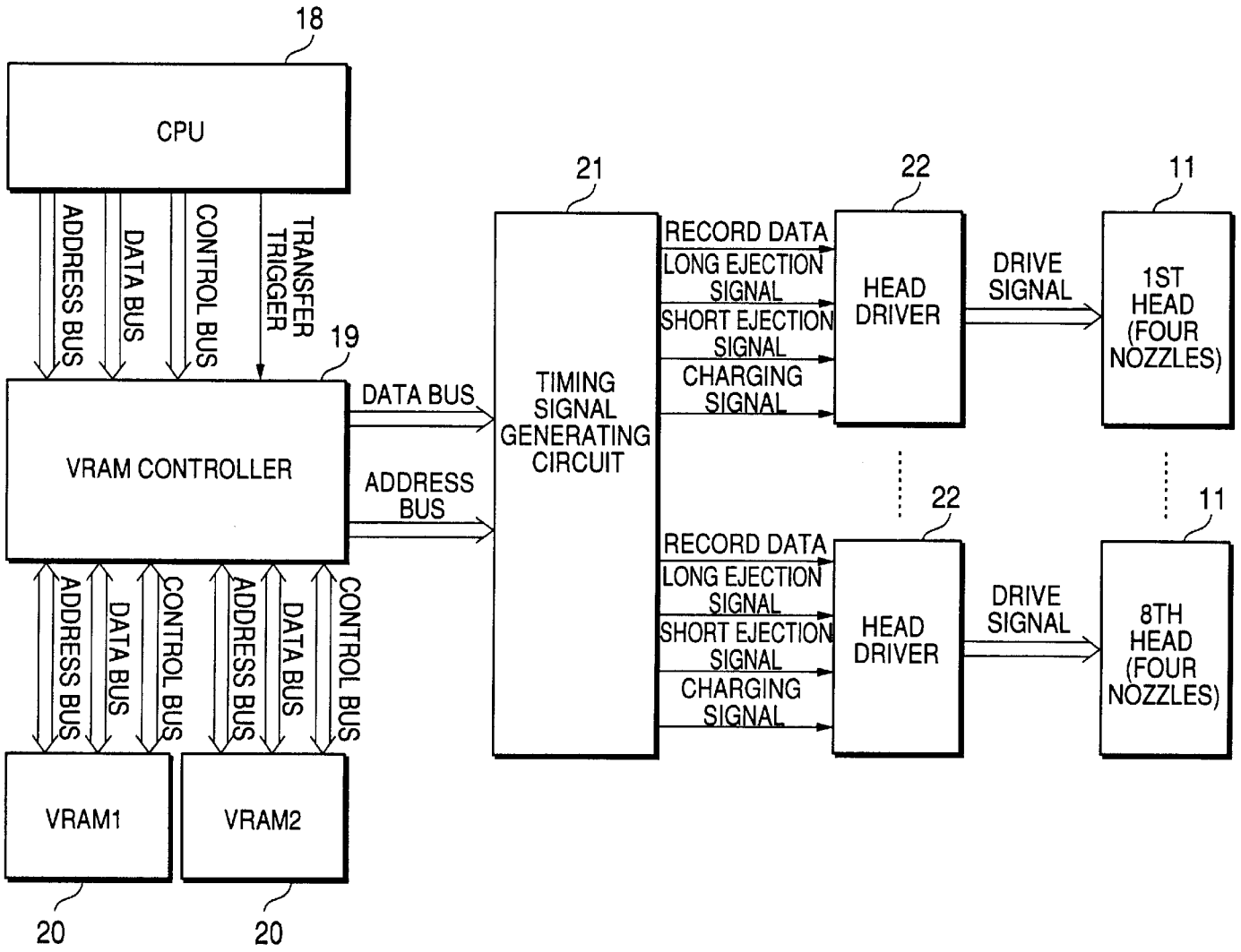
FIG. 3 is a block diagram showing one embodiment of a control circuit for use in the ink jet printer of the present invention.

FIG. 3 shows one embodiment of a control circuit for use in the ink jet printer of the present invention. CPU 18 is connected to one end of an address bus for inputting/outputting address signal to designate predetermined address, a data bus via which predetermined record data is inputted/outputted and a control bus via which a predetermined control signal is inputted/outputted. The other end of each of the buses is connected to VRAM (Video Random Access Memory) controller 19. A transfer trigger is transmitted to the VRAM controller 19 from CPU 18 at a constant cycle.

The VRAM controller 19 is connected to two VRAM 20, 20 via address buses for inputting/outputting address signals to designate predetermined addresses, data buses for inputting/outputting the predetermined record data, and control buses for inputting/outputting predetermined control signals. The CPU 18 selects VRAM 20 to be accessed in accordance with register setting inside the VRAM controller 19. Stored in the selected VRAM 20 are data for one scanning operation, i.e., the record and timing data for eight lines recorded by one back and forth scanning operation for each color, because the ink jet head 11 has four nozzles 12 and two ink jet heads 11 is used for one color.

Figure 4:
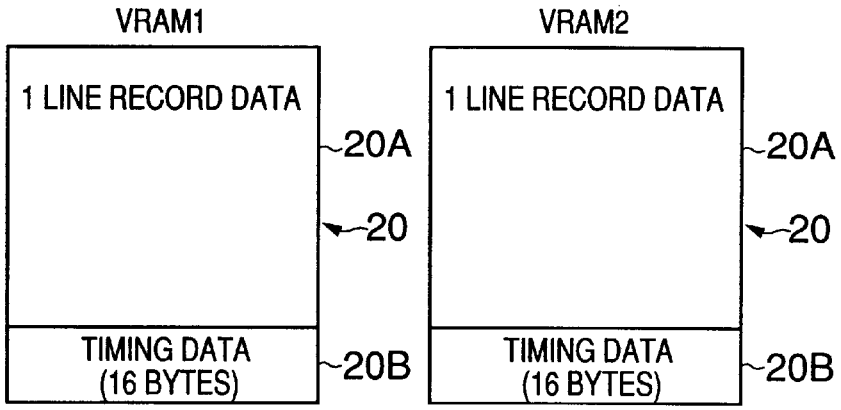
FIG. 4 is an explanatory view showing the structure of VRAM of FIG. 3.

As shown in FIG. 4, the record area of VRAM 20 is divided into a record data storage area 20A and a timing data storage area 20B.

Figure 5:
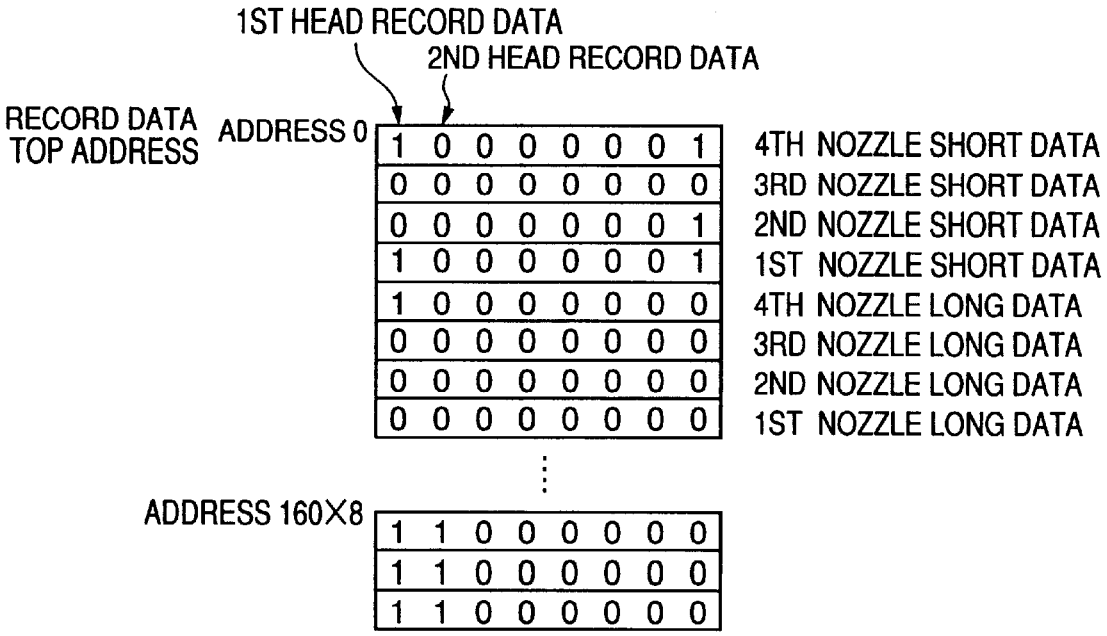
Fig. 5 is an explanatory view showing recording condition of record data in the control circuit of FIG. 3.

As shown in FIG. 5, short and long record data are written into preset addresses of the record data storage area 20A corresponding to the first to fourth nozzles 12 of each of the first to eighth heads 11. In the embodiment, eight bytes of record information for one dot are used. As seen in FIG. 2, the first head 11A to the eighth head 11H are arranged with constant intervals of 160 dots (pixels). Therefore, the second head record data is written from address 160×8 (=500 h), and the third to eighth head record data are written in addresses in which timings are sequentially deviated in accordance with the number of dots between the heads 11. The long record data is used for ordinary recording. The short record data has ink ejection time shorter than the ejection time by the long record data, and is used when a plurality of colors are overlapped and recorded.

As shown in FIG. 6, the timing data for the first head 11A to the eighth head 11H are written in preset addresses in the timing data storage area 20B. The timing data are formed of long ejection start data, short ejection start data, long and short ejection end data, and charging end data. When there is no positional deviation in the moving direction of the heads 11A to 11H, i.e., when the interval between the heads 11 is correctly kept at 160 dots, the timing data for the first head 11A to the eighth head 11H are written in the same writing address. Moreover, when a positional deviation (interval deviation) of the moving direction occurs among the heads 11A to 11H, one pitch (less than one-sixteenths of time width for recording one dot) corresponds to one address value. The head positional deviation of an integer (<16) times one pitch can be adjusted by the position of the address. FIG. 6 shows a case where the position of the eighth head 11H is deviated by seven pitches relative to the positions of the first head 11A to the seventh head 11G, and the writing address of the timing data is adjusted or deviated by seven pitches. Additionally, in the embodiment, since the data amount of the timing data is 16 bytes, the length of 16 bytes equals the length of the timing data (FIGS. 8, 9), and the length corresponds to the ink ejection time width. The data amount is not limited to 16 bytes, and can be appropriately set. Thereby, the adjustment unit of deviation can also be considered.

The VRAM controller 19 is connected to a timing signal generating circuit 21 via an address bus for inputting/outputting an address signal to designate the predetermined address and a data bus for inputting/outputting the predetermined record data. The VRAM controller 19 reads record and timing data for one dot from VRAM 20 designated by CPU 18 by the transfer trigger transmitted from the CPU 18, and transfers these data to the timing signal generating circuit 21.

The timing signal generating circuit 21 is connected to head drivers 22 of the ink jet heads 11 for outputting drive signals to operate each head nozzle 12. The timing signal generating circuit 21 decodes the address transmitted from the VRAM controller 19. Thereby, the record data is transmitted to each head driver 22 during record data transfer period, and each timing data of a long ejection signal, a short ejection signal and a charging signal is transmitted during timing data transfer period.

Here, the long ejection signal is "1" from when the long ejection start data shown in FIG. 6 turns to ONE until the long/short ejection end data turns to ONE. The short ejection signal is similarly "1" from when the short ejection start data shown in FIG. 6 turns to ONE until the ejection end data turns to ONE. The charging signal is "1" from when the ejection end data turns to ONE until the charging end data turns to ONE.

Figure 7:
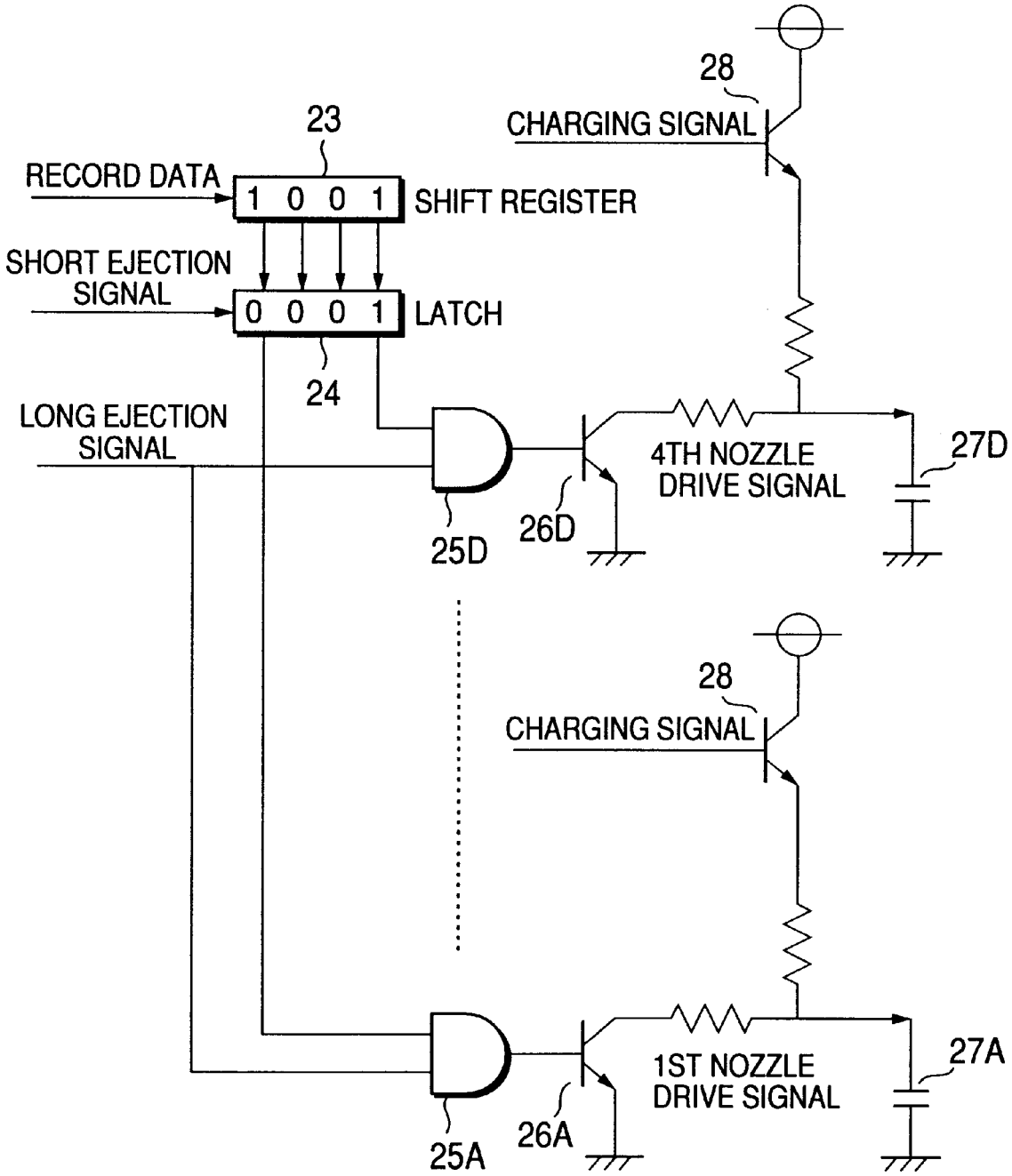
FIG. 7 is a circuit diagram showing one embodiment of an electric circuit of a head driver of the control circuit shown in FIG. 3.

FIG. 7 shows one embodiment of an electric circuit of the head driver 22. Numeral 23 denotes a shift register to which the record data is transmitted from the timing signal generating circuit 21. The short record data of the first nozzle 12A to the fourth nozzle 12D are transmitted to the shift register 23. The short ejection signal is transmitted to the head driver 22 from the timing signal generating circuit 21.

The long record data 0001 and the short record data 1001 of the nozzles 12A to 12D are transmitted in this sequence to the shift register 23. When the short record data 1001 is transmitted to the shift register 23, the long record data 0001 previously transmitted to the shift register 23 is transferred to the latch 24.

Figure 8:
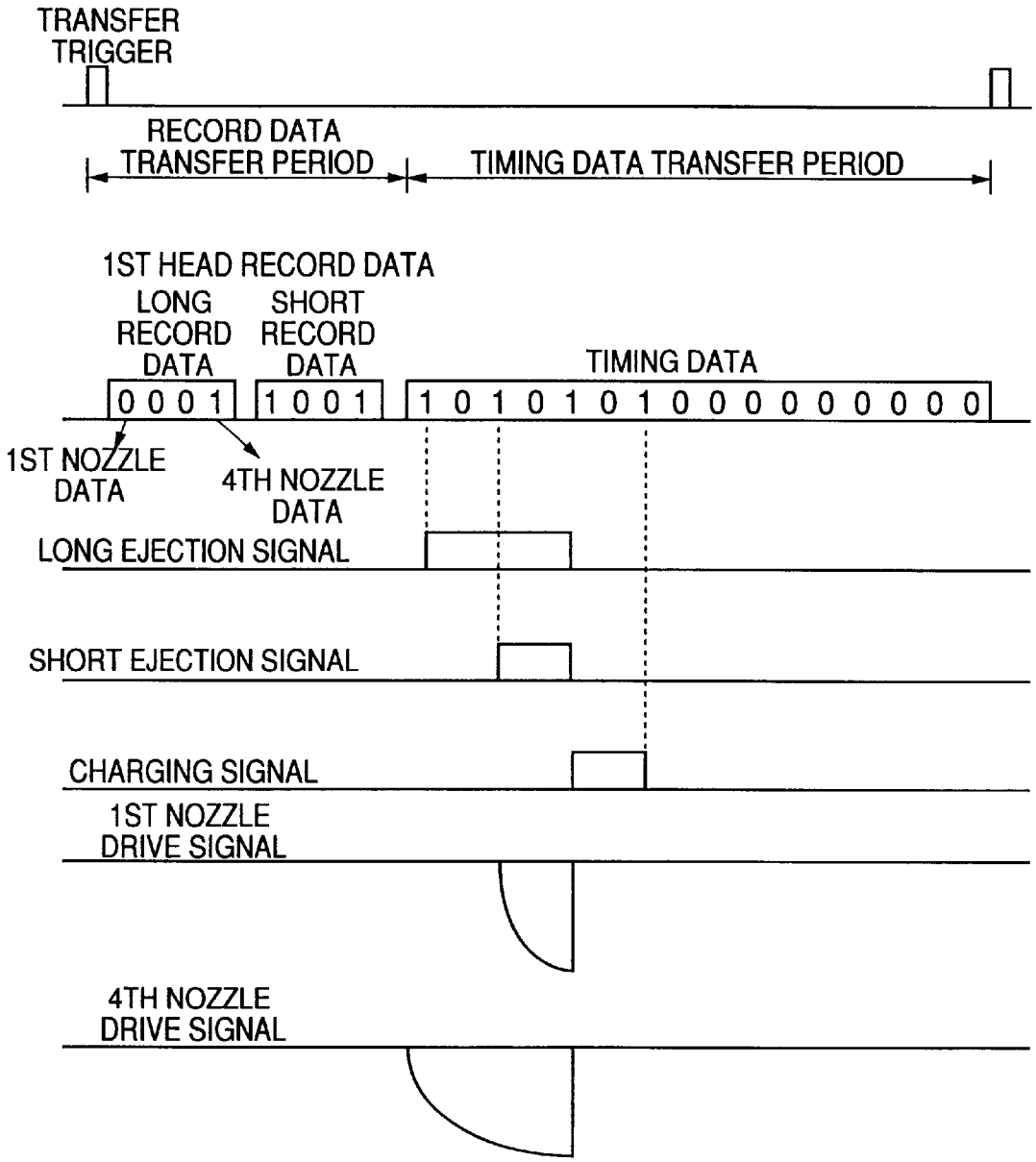
FIG. 8 is a timing chart showing operation of a first ink jet head by the control circuit of FIG. 3.

The head driver 22 is provided with four AND circuits 25A to 25D for the first nozzle 12A to the fourth nozzle 12D, and each long record data stored in the latch 24 is independently transferred to one input terminal of each AND circuit 25. Transmitted to the other input terminal of each AND circuit 25 is the long ejection signal from the timing signal generating circuit 21 at the timing shown in FIG. 6. A base of each transistor 26 (26A to 26D) is connected to the output terminal of each AND circuit 25. An emitter of the transistor 26 is grounded, and a collector is connected to a base of each piezoelectric element 27 (27A to 27D) for operating the head nozzle 12 via a resistance. The head driver 22 is also provided with a transistor 28, which is controlled to turn ON/OFF by the charging signal from the timing signal generating circuit 21. The transistor 28 is interposed between a direct current power supply and a charging terminal of piezoelectric element 27 to electrically charge the piezoelectric element 27. As shown in FIG. 8, the charging signal turns ON based on the ejection end signal, and turns OFF based on the charging end signal. As a result, the piezoelectric element 27 is constantly held in its charged condition at the time of non-ejecting. In the charged condition, the piezoelectric element 27 places an ink flow path in a closed condition, and holds the condition not to eject the ink.

The head driver 22 constructed as described above is provided for each of the first to eighth heads.

The operation of the embodiment having the aforementioned structure will next be described.

First, when the record data is fed to CPU 18, the record data is transmitted to the VRAM controller 19, and record and timing data for recording one line of dots are written into VRAM 20 selected by the CPU 18. The next one-line record and timing data are written in the other VRAM 20.

Subsequently, the VRAM controller 19 reads the record and timing data for one dot from the VRAM 20 designated by the CPU 18 in accordance with the transfer trigger transmitted from the CPU 18, and transfers the read data to the timing signal generating circuit 21. The timing signal generating circuit 21 decodes the address transmitted from the VRAM controller 19 to first transmit the short and long record data to each head driver 22 during the record data transfer period.

The timing signal generating circuit 21 successively transmits the timing data of the long ejection signal, short ejection signal and charging signal during the timing data transfer period. FIG. 8 shows the transfer timing of the record and timing data. In the embodiment of FIG. 8, the long ejection signal turns ON by the first appearing data "1" (first byte), and the short ejection signal turns ON by the second data "1" (third byte). The charging signal turns ON by the third data "1" (fifth byte). The charging signal also serves as the ejection end signal, and the long and short ejection signals are turned OFF to "0" when the charging signal turns ON. By the fourth data "1" (seventh byte), the charging signal turns OFF.

The head driver 22 operates the head nozzle 12 by the record and timing data to eject the ink from the head nozzle 12. The operation will be described later. Recording is performed on the recording sheet conveyed between the platen 5 and the ink jet head 11 by a sheet conveying device (not shown).

The ejection operation of the head nozzle 12 is performed in synchronization with the scanning operation of the carriage 8 which is moved along the carriage shafts 7 by operating the carriage drive belt 9.

Figure 9:
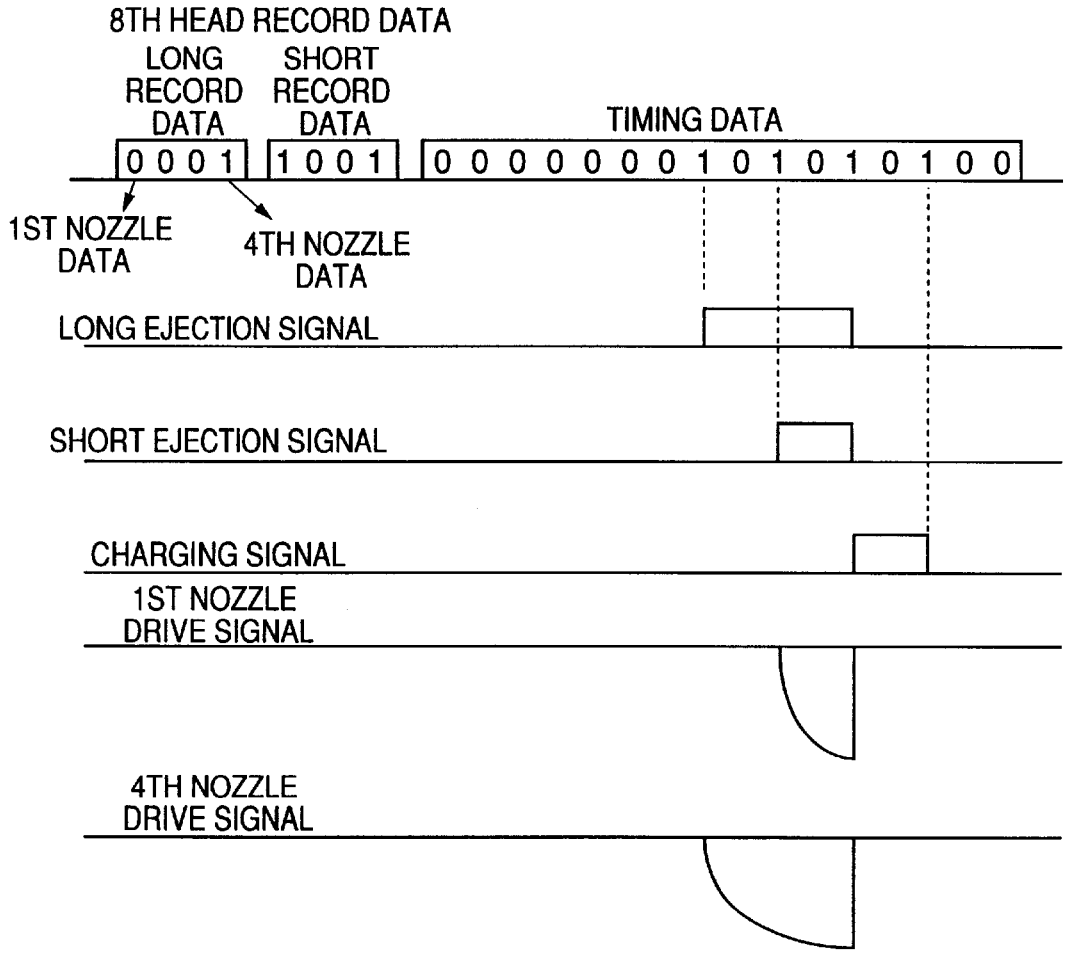
FIG. 9. is a timing chart showing operation of an eighth ink jet head by the control circuit of FIG. 3.

The operation of the head driver 22 will next be described in detail. As shown in FIGS. 7 to 9, first during the record data transfer period, the long record data 0001 of the first head is transferred to the shift register 23 from the timing signal generating circuit 21.

The long record data 0001 in the shift register 23 is transferred to the latch 24 in response to the next timing signal, and the short record data 1001 is transferred to the shift register 23. In this case, since the content of the latch 24 is 0001, a signal "1" is transmitted to one input terminal of AND circuit 25D for the fourth nozzle 12D. signals "0" are transmitted to the AND circuits 25A to 25C of the first to third nozzles 12A to 12C.

Since the long ejection signal is transmitted to the other input terminal of each of AND circuits 25A to 25D at the timing shown in FIG. 8, only the AND circuit 25D outputs a signal "1" when the long ejection signal turns to "1". Therefore, only the transistor 26D turns ON, the electric charge of the piezoelectric element 27D is discharged through the transistor 26D, and the piezoelectric element 27D opens the ink flow path of the fourth nozzle 12D. As a result, the ink is ejected only from the fourth nozzle 12D.

Thereafter, in the timing data transfer period, the timing signal generating circuit 21 outputs the short ejection signal for the first head 11A at the timing shown in FIG. 8. The latch 24 reads therein the short record data 1001 stored in the shift register 23 in response to the short ejection signal. That is, the data of the latch 24 is rewritten to the short record data 1001 from the long record data 0001 by the short ejection signal.

The short record data is 1001. Specifically, since the short record data of the first nozzle 12A and the fourth nozzle 12D are "1", the ink is ejected from the first and fourth nozzles in response to the long ejection signal transmitted to the AND circuit 25. As a result, the first nozzle 12A starts ejecting the ink at the timing of the short ejection signal. Moreover, the fourth nozzle 12D continues to eject the ink following the long ejection signal.

Subsequently, when the timing signal generating circuit 21 outputs the ejection end signal, the long and short ejection signals both turn to "0", while the charging signal turns to "1". Therefore, the first and fourth nozzles 12A, 12D both stop ejecting the ink based on the ejection end signal, and the piezoelectric elements 27A, 27D are electrically charged for a given time. In this manner, the ink is ejected from the first nozzle 12A only for a short time, and from the fourth nozzle 12D for a long time in accordance with the long and short record data.

As described above, for the dot recorded by overlapping a plurality of colors of ink, the ink amount is reduced by shortening the ink ejection time in accordance with the short record data, so that ink blur or the like on the recording sheet can be prevented from occurring.

The recording of one dot is completed by the aforementioned operation. Subsequently, the VRAM controller 19 reads the record and timing data of the next dot in response to the transfer trigger transmitted from the CPU 18, and transfers the read data to the timing signal generating circuit 21. The timing signal generating circuit 21 transmits to each head driver 22 the long record data, the short record data, the long/short ejection signal, the charging signal, and the like at the predetermined timings based on the record and timing data. As a result, the predetermined head nozzle 12 ejects the ink.

When the aforementioned operation is repeated for each head 11 to complete the recording of one line, the record and timing data for one dot are read from the other VRAM 20, and recording of each dot is performed in the same manner. On the other hand, the record and timing data for the next one line are further written to the VRAM 20, in which the recorded/completed record data has been written.

Subsequently, the recorded recording sheet is wound up by the wind-up shaft 17 rotated/operated in synchronization with the conveying operation of the sheet conveying device. Thereby, the printed recording sheet can be prevented from creasing or folding.

Moreover, when the intervals among the ink jet heads 11A to 11H are constant (160 dots), no problem occurs. However, in some case the intervals among the ink jet heads 11A to 11H are not constant due to less mounting accuracy of the ink jet heads 11A to 11H. For example, when there is a deviation less than one dot size in the mounting interval of the ink jet heads 11A to 11H, if the head nozzle 12 is operated in accordance with the timing data corresponding to the correct interval of each of the ink jet heads 11A to 11H to perform recording, a recording deviation of one dot is generated.

Therefore, in the embodiment, the output timing of the timing data is controlled relative to the deviation of position (interval) of the ink jet head 11. More specifically, the timings of the long ejection start data, short ejection start data, long and short ejection end data, and charging end data are deviated/adjusted corresponding to the positional deviation of the head 11, so that the recording deviation is eliminated.

For example, a straight line extending in the conveying or feeding direction of the recording sheet is first recorded on the recording sheet. By judging whether or not the recorded straight line is completely straight, it can be judged whether or not the position of each of the ink jet heads 11A to 11H is deviated. Subsequently, the output timing of the timing data is adjusted corresponding to the deviation of the straight line, and the adjustment of timings of the ink jet heads 11A to 11H is completed at the time the completely straight line is recorded.

In this case, in the embodiment, since the data volume of the timing data is 16 bytes and the number of bytes necessary for the timing data is set to seven bytes (refer to FIG. 6), the timing of less than one dot can be adjusted in a range of (16−7)=9 bytes.

FIG. 9 shows a timing chart in which the ink ejection timing of the ink jet nozzle 11 is adjusted by deviating the output timing of the timing data. Here, a case is shown where there is a positional deviation in the eighth head 11H. Specifically, in this case, as shown in FIG. 6, for the timing data of the eighth head 11H, the long ejection start data is transmitted at the eighth byte, the short ejection start data is transmitted at the tenth byte, the long/short ejection end data is transmitted at the twelfth byte, and the charging end data is transmitted at the fourteenth byte. Therefore, as shown in FIG. 9, the timing signal generating circuit 21 outputs the long ejection signal "1" from the eighth byte, outputs the short ejection signal (turns the signal to "1") from the tenth byte, and turns off the signals to "0" at the twelfth byte. Specifically, the timing at which the head 11H ejects the ink is deviated by the time corresponding to seven bytes relative to the timing at which the heads 11A to 11G eject the ink. Therefore, the positional deviation of the head 11 can be adjusted by appropriately setting the deviation in the ejection time.

Additionally, the adjustment range of the ejection timing of each head 11 is enlarged by increasing the data amount of the timing data to 16 bytes or more, so that finer timing adjustment can be realized.

Moreover, for example, when the ink jet printer is provided with an adjusting operation plate or the like for independently adjusting the timing of each of the ink jet heads 11A to 11H to perform +/−adjustment of timing, the timing adjustment can easily be performed.

Additionally, the timing adjustment is performed when the positional deviation occurs because of inferior mounting accuracy of the ink jet heads 11A to 11H. Therefore, the timing adjustment is preferably performed at the time of delivery from the factory.

Accordingly, in the embodiment, even if the mounting position of the ink jet heads 11A to 11H is deviated within a range of one dot, the ink ejection timing from the head nozzle 12 can be adjusted by adjusting the timing data by the control circuit, so that the adequate recording can be performed without any dot deviation and the recorded image quality can be enhanced.

Additionally, the present invention is not limited to the aforementioned embodiment, and can be modified variously as required.

As described above, according to the control method of the present invention, when a plurality of colors of ink are overlapped to record the dot, the ejection time length of each color ink is set shorter as compared with when a single-color dot is recorded. Therefore, the ink amount in the dot with the plurality of colors overlapped therein is reduced, ink blur or the like is prevented from occurring on the recording sheet, and the recorded image quality can be enhanced.

Moreover, according to the ink jet printer of the present invention, the printer for direct use in implementation of the control method can be obtained.

What is claimed is:

1. A control method of an ink jet printer having an ink jet head which ejects an ink droplet to record a dot on a recording sheet, the ink jet head being mounted on a carriage reciprocating in a direction substantially orthogonal to a conveying direction of the recording sheet, comprising the steps of:

dividing an ejection time width for recording one dot of ink ejected from said ink jet head into a plurality of pitches;

preparing timing data indicating plural ejection time lengths of said ink jet head corresponding to said pitches:

determining the ejection timing for each dot from said timing data: and controlling each dot ink ejection time length by the determined ejection timing;

wherein the timing data includes a plurality of ejection start signals stored in different addresses and one election end signal.

2. A control method of an ink jet printer having an ink jet head which ejects an ink droplet to record a dot on a recording sheet, the ink jet head being mounted on a carriage reciprocating in a direction substantially orthogonal to a conveying direction of the recording sheet, comprising the steps of:

dividing an ejection time width for recording one dot of ink ejected from said ink jet head into a plurality of pitches;

associating each pitch with an address of a timing data memory;

preparing timing data by storing data indicating plural ejection time lengths of said ink jet head in the address corresponding to ejection timing;

providing selection information for selecting any one of said plural ejection time lengths, said selection information being included in record data for each dot;

determining the ejection timing for each dot from said timing data on the basis of the ejection time length selected by the selection information of said record data; and controlling each dot ink ejection time length by the determined ejection timing.

3. The control method of claim 2, wherein the timing data includes a plurality of ejection start signals stored in different addresses and one ejection end signal, the record data includes the selection information for selecting any one from said ejection start signals, and ink ejection is started from the address of the ejection start signal selected by said selection information and completed at the address of the ejection end signal.

4. The control method of claim 3, wherein said timing data memory is provided in RAM for recording the record data for one scanning operation, the record data for one dot is read from said RAM and temporarily stored in a shift register, the timing data stored in said timing data memory is read in address order to obtain an ejection start timing for the selection information included in the record data, the ink corresponding to said record data starts to be ejected at the obtained ejection start timing, and ink ejection is completed by said ejection end signal.

5. The control method of claim 4, wherein the record data includes long record data indicating a long ejection time and short record data indicating a short ejection time, and wherein the timing data includes long ejection start data, short ejection start data and one ejection end data, the ejection start timing indicated by the long ejection start data being in advance of the ejection start timing indicated by the short ejection start data, the ejection end data indicating the end of the long or short ejection time.

6. The control method of claim 2, wherein a plurality of ink jet heads are provided, and data indicative of the ejection timing for each ink jet head is set in such a manner that the respective recording address is changed independently of the timing data memory.

7. An ink jet printer in which an ink jet head is mounted on a carriage reciprocating in a direction substantially orthogonal to a conveying direction of a recording sheet, comprising:

CPU for outputting record data including data indicating an ink ejection time length for each dot;

a record data memory for sequentially storing a predetermined volume of record data while said ink jet head is moving along a recording path;

a timing data memory for dividing an ejection time width for recording one dot of ink ejected from said ink jet head into a plurality of pitches, associating each pitch with an address position, and storing data indicating plural ejection time lengths in an address corresponding to ejection timing;

a timing signal generating circuit for reading and outputting the record data for one dot from said record data memory, and for reading the ejection timing corresponding to the ejection time length indicated by said record data from said timing data memory to output an ejection signal at a predetermined ejection timing; and a head driver for operating the ink jet head based on said record data for one dot and said ejection signal to eject the ink corresponding to said record data at said predetermined ejection timing.

8. The ink jet printer according to claim 7, wherein the record data memory and the timing data memory are formed in different storage areas in a common memory.

9. The ink jet printer according to claim 7, wherein the record data for one scanning operation by the ink jet head is stored in the record data memory.

10. The ink jet printer according to claim 9, comprising a plurality of memories for storing the record data and the timing data, so that the record data for one scanning operation is sequentially recorded in the record data storage area of each memory.

* * * * *